US005134555A

United States Patent [19]

Messana

[11] Patent Number: 5,134,555

[45] Date of Patent: Jul. 28, 1992

[54] SELF POSITIONING LAMP FIXTURE

[76] Inventor: Joseph Messana, 1343 S. Schmuhl Rd., New Lenox, Ill. 60451

[21] Appl. No.: 756,674

[22] Filed: Sep. 9, 1991

[51] Int. Cl.[5] ..... F21V 21/00

[52] U.S. Cl. ..... 362/382; 362/401; 362/410; 362/418; 362/429

[58] Field of Search ..... 362/382, 401, 402, 410, 362/413, 414, 418, 429

[56] References Cited

U.S. PATENT DOCUMENTS

| | | | |
|---|---|---|---|
| 713,364 | 11/1902 | Uhlenhart | 362/401 |
| 1,228,615 | 6/1917 | Stafford | 362/401 |
| 4,028,543 | 6/1977 | Oster | 362/401 |
| 5,001,617 | 3/1991 | Chan | 362/401 |

FOREIGN PATENT DOCUMENTS

| | | | |
|---|---|---|---|
| 714784 | 11/1931 | France | 362/410 |
| 312687 | 11/1933 | Italy | 362/401 |
| 313174 | 7/1930 | United Kingdom | 362/410 |

*Primary Examiner*—Ira S. Lazarus
*Assistant Examiner*—Sue Hagarman
*Attorney, Agent, or Firm*—Ernest Kettelson

[57] ABSTRACT

A self positioning lamp fixture comprises an elongated stand having a lamp component on its upper end and a self-righting or self-positioning structure at its lower end. The self-righting or self-positioning structure comprises a hemi-spherical bottom wall with a rounded outer surface for contact with the horizontal surface on which the lamp fixture is placed, and a volume of weighted material or ballast uniformly dispersed in the hemi-spherical cavity bounded by the hemi-spherical bottom wall below the horizontal equatorial plane through the upper edge of the hemi-spherical bottom wall, such ballast having sufficient weight relative to the weight of the rest of the lamp fixture which is above to lower the center of gravity below the horizontal equatorial plane. Thus, when the lamp fixture is tipped or tilted from its vertical position, it pivots around such lowered center of gravity on the rounded outer surface of the bottom wall and gravitational forces acting on the weight of the ballast much as a teeter-totter brings the tilted lamp fixture back to its upright or vertical position.

6 Claims, 2 Drawing Sheets

SELF POSITIONING LAMP FIXTURE

BACKGROUND OF THE INVENTION

This invention relates to the field of lamp fixtures and devices which deter or prevent the lamp fixture from being inadvertently tipped over and damaged. The invention is particularly directed to lamp fixtures for use at work sites in the construction industry, but it is also applicable to any other kind of lamp which is supported on a stand or other type of upright fixture such as a table lamp, lantern and the like.

The existing lamp fixtures for use at work sites in the construction industry, such as the quartz lamps known to the prior art, are supported on an adjustable elongated shaft which is held upright by a tripod. These prior art lamp fixtures are easily tipped over when accidentally bumped into by a workman, and the quartz lamp is broken requiring expensive replacement.

This problem is solved by the self positioning or self-righting lamp fixture in accordance with the present invention. It provides an elongated supporting structure for the lamp mounted at its upper end which has a hemi-spherical bottom wall bounding a hemi-spherical cavity in which a volume of weighted material or ballast is uniformly dispersed and secured to lower the center of gravity of the fixture as a whole to some point below the equatorial plane through the upper circumferential edge of the hemi-spherical cavity defined by the curvature of the bottom wall. The weight of the uniformly dispersed ballast is determined by whatever is needed to cause the elongated supporting structure with a quartz lamp mounted at its upper end when laid on its side horizontally to right itself and return to the vertical or upright position.

In other words, the uniformly dispersed ballast in the lower part of the hemi-spherical or rounded bottom wall of the supporting structure is of sufficient weight for gravitational forces acting thereon when the structure is tipped or tilted from its upright or vertical position to cause it pivot back to the upright or vertical position, and to also act as a buffer or restraining force against movement away from the upright or vertical position. Thus, when accidentally bumped into by a workman, the lamp fixture in accordance with this invention will initially be tipped away from its upright position but as soon as the workman steps away the gravitational forces acting on the weighted ballast automatically bring the lamp fixture back to its normal upright position.

SUMMARY OF THE INVENTION

It is an object of the invention to provide a self-positioning or self-righting lamp structure comprising a supporting structure having a lamp mounted on its upper end and a rounded bottom wall with sufficient weight in the lower part of the structure to hold the structure upright and cause it to rotate back to the upright position when tipped toward the horizontal position.

DESCRIPTION OF PREFERRED EMBODIMENT

Figure 1:
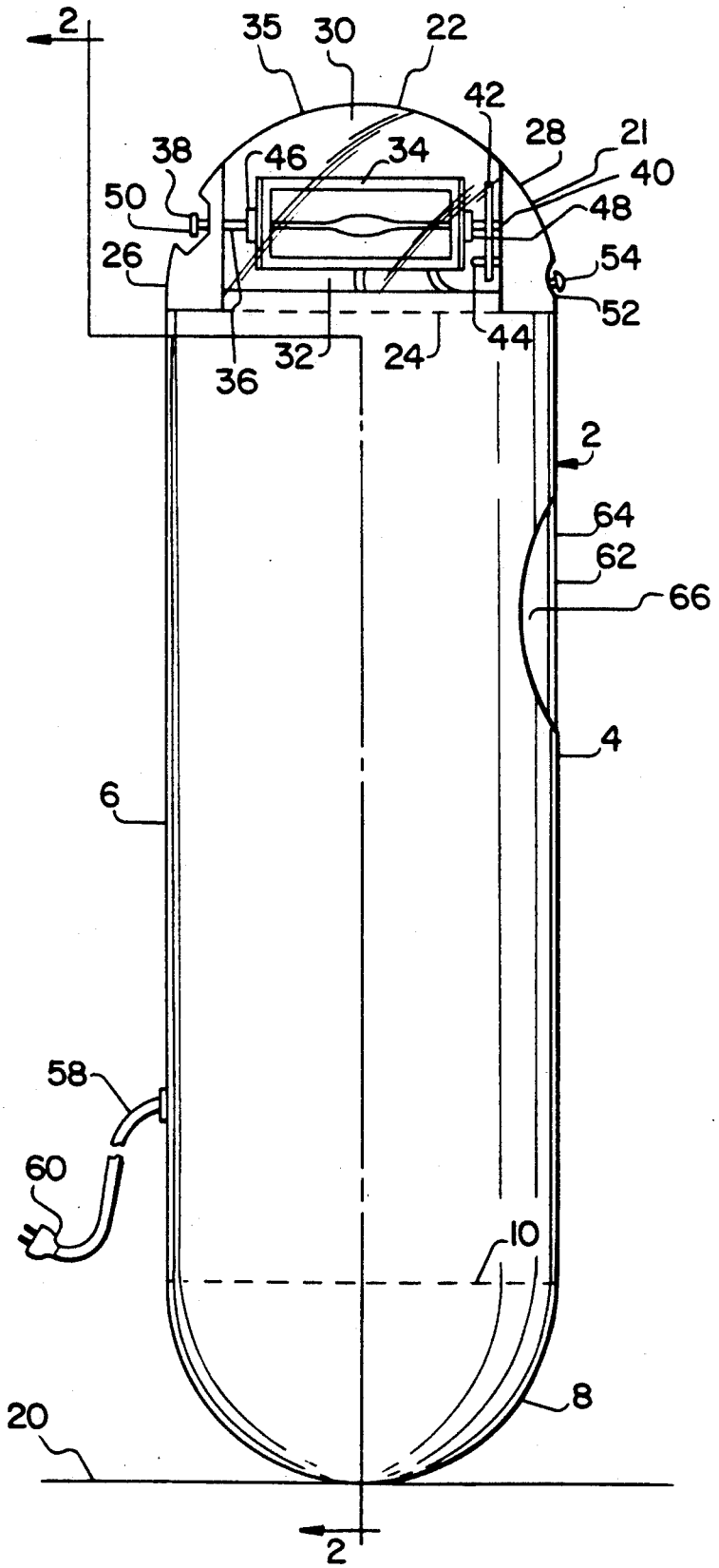
FIG. 1 is an elevation view of a self-positioning or self-righting lamp fixture in accordance with this invention.
Figure 2:
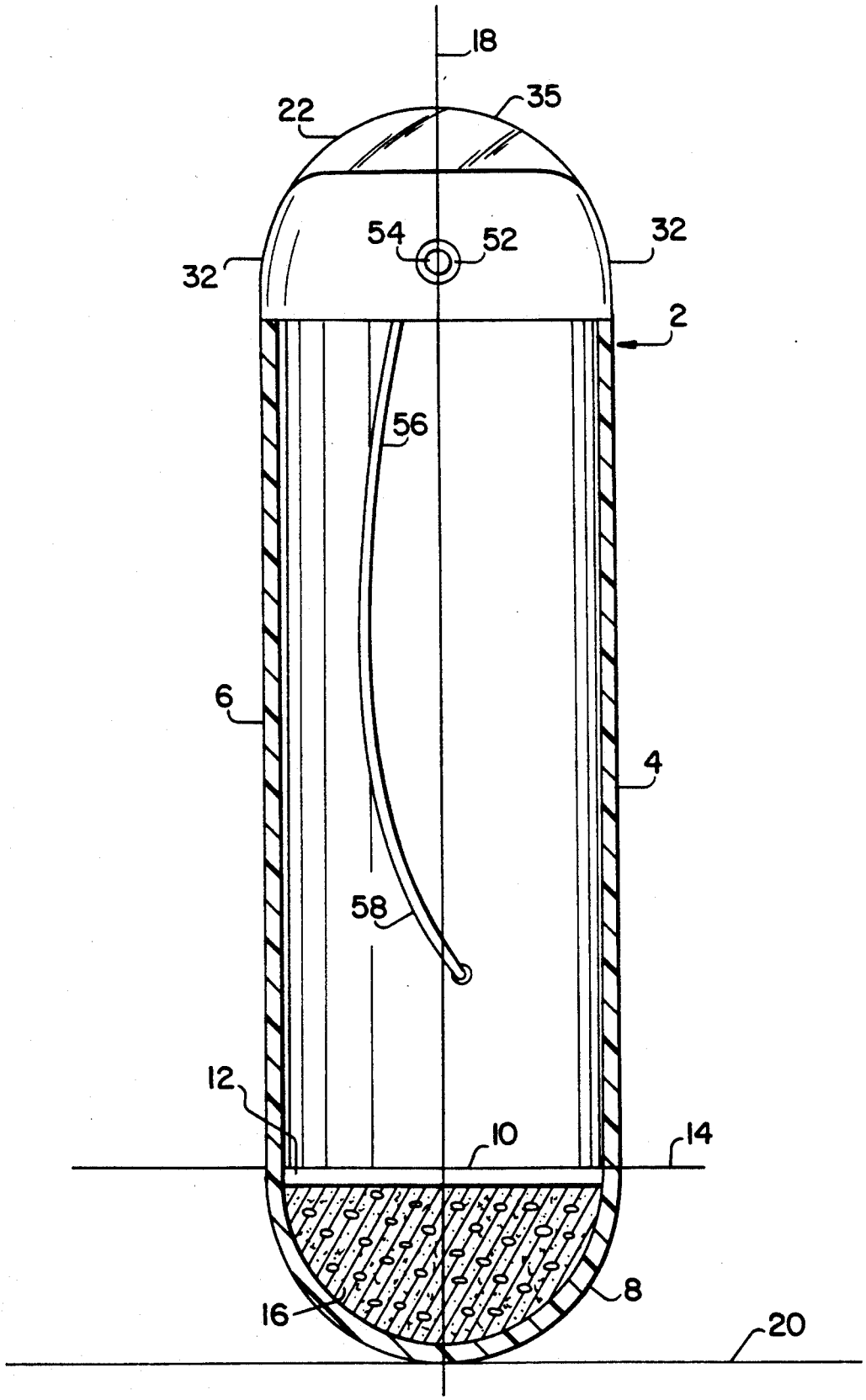
FIG. 2 is a section view taken on line 2—2 of FIG. 1.

A self positioning lamp fixture in accordance with the present invention has a rounded bottom wall and sufficient weight in the lower portion to lower the fixture's center of gravity enough to enable it to right itself when tipped over. This feature may be incorporated in any kind of lamp fixture, including table lamps, camping lamps and lanterns, and the like. The particular lamp fixture described in detail in this patent specification is a quartz lamp fixture used on job sites by construction crews.

The quartz lamp fixture 2 comprises an elongated body portion 4 having a cylindrical side wall 6 and a rounded hemi-spherical bottom wall 8 which integrally joins the cylindrical side wall 6 at an equator region 10. The hemi-spherical bottom wall 8 encompasses and bounds a hemi-spherical cavity 12 extending downwardly from a plane 14 through the equator region 10. A volume of weighted material or ballast 16 of a predetermined weight is secured in place within the hemi-spherical cavity 12 below the equatorial plane 14 and spaced apart downwardly therefrom. The pre-determined weight of the ballast 16 in the cavity 12 is equalized around the periphery of the hemi-spherical cavity 12 and of uniform weight as it extends radially outwardly from the longitudinal axis 18 of the fixture.

The pre-determined weight of the ballast 16 is that which will lower the center of gravity of the lamp fixture 2 to a point below the equatorial plane 14. Such weight may be calculated by formula or by experiment. The lamp fixture 2 may be laid on its side on the horizontal position and weight added to the ballast 16 in the hemi-spherical cavity 12 until it is sufficient to counter-balance the weight of the rest of the lamp fixture 2 laying in the horizontal position causing it to rotate on the rounded surface of the bottom wall 8 back to the upright position.

When the weight of the ballast 16 below the equatorial plane 14 is great enough to counter-balance the weight of that part of the lamp fixture above the equatorial plane when in the horizontal position, the center of gravity will be below the equator region 10 of the hemi-spherical bottom wall 8. Since the weight of the ballast 16 is equalized on and around all sides outwardly from the longitudinal axis 18, gravitational forces will act on such equalized weight ballast 16 to position the longitudinal axis 18 of the lamp fixture 2 in a vertical line upwardly from a horizontal surface 20 on which it is placed.

If the lamp fixture 2 and its longitudinal axis 18 is tipped or tilted away from such vertical or upright position, the lamp fixture 2 pivots on its center of gravity whereupon the gravitational forces acting on the ballast 16 become unbalanced exerting less gravitational pull on that portion on the side toward which the fixture is tipped and greater gravitational pull on the diametrically opposite side of the ballast 16. The rounded surface of the hemi-spherical bottom wall 8 enables the greater pull of gravitational forces on one side portion of the ballast 16 to rotate the bottom wall 8 and lamp fixture 2 back to its original vertical or upright position.

The greater the weight of the ballast 16 above the weight needed to counter-balance the weight of that part of the lamp fixture which is above the equatorial plane 14 when in the horizontal position, the more firmly will the gravitational forces acting on the ballast 16 hold the lamp fixture 2 and its longitudinal axis in the vertical or upright position and the quicker it will reposition the lamp fixture 2 to its upright position when tipped away from such upright position.

The lamp fixture 2 which is shown and described herein also includes a hemi-spherical top wall 21. It should be noted however that the portions of the lamp fixture above the equatorial plane 14 could be any desired shape, configuration and design and still come within the self-righting, or self-positioning aspects of the present invention as long as the lamp fixture includes the structure below the equatorial plane 14 as described above.

The hemi-spherical top wall 21 has a rounded outwardly facing surface 22 which integrally joins the cylindrical side wall 6 at a second equator region 24. The hemi-spherical top wall 21 includes a pair of arcuate spaced apart side walls 26 and 28 on opposite sides of a top wall cavity 30 which opens at each opposite end to open end walls 32. The hemi-spherical top wall 21 includes an arched transparent cover 35 positioned between the arcuate side walls 26 and 28, whose outwardly facing convex surface is part of the rounded outwardly facing surface 22 of the top wall 21.

A quartz lamp 34 is mounted in the top wall cavity 30 on a two-part pivot rod 36, one part of which extends through a bearing aperture through arcuate side wall 26 and terminates in a rotatable end having a rotatable adjustment knob 38 thereon to rotate the quartz lamp 3 to whatever angle desired relative to the longitudinal axis of the lamp fixture. The opposite end 40 of the other part of pivot rod 36 is received in a bearing recess of the opposite arcuate side wall 28 to thereby rotatably support the quartz lamp 34 in the top wall cavity 30 facing one or the other of the open end walls 32 thereof.

A stop bar 42 is welded or otherwise secured to the pivot rod 36 at a location thereon which is between the arcuate side wall 28 and the side of quartz lamp 34 facing the side wall 28. A molded stop member 44 extends inwardly of the top wall cavity 30 from the arcuate side wall 28 and across the arcuate path of stop bar 42 as it is rotated on the pivot rod 36 with the quartz lamp 34. The stop bar prevents further rotation of the stop bar 42 and quartz lamp 34 beyond the lowest angle at which the lamp 34 can shine through the open end wall 32 and transparent cover 35 in place thereon.

A pair of shock mounts 46 and 48 of resilient shock-absorbing material are provided on each opposite side of the quartz lamp 34 having grip type apertures to receive, grip and hold respective connecting ends of the two-part pivot rod 36.

The top arcuate side wall 26 includes a first recess 50 in which the rotatable adjustment knob 38 to rotate the pivot rod 36 and quartz lamp 34 is located.

A second recess 52 is formed in the opposite top arcuate side wall 28 in which a switch 54 is positioned to turn the quartz lamp 34 off and on. The switch 54 is connected in the lamp circuit 56 which includes conductor 58 and outlet plug 60 for plugging into the electrical supply circuit of a building or other electrical outlet at a construction site.

A handle 62 to carry the lamp fixture 2 is provided on the cylindrical side wall 6, comprising a handle bar 64 extending in line with the outer surface of the cylindrical side wall 6 and cut-outs 66 on each opposite side of the handle bar 64 for a user's fingers to extend through when gripping the handle bar 64.

A typical quartz lamp fixture for use on construction sites is about five feet in height. An appropriate size cylindrical wall self-positioning housing in accordance with the present invention for a fixture that is five feet tall is about two feet in diameter around the equator region 10 of the hemi-spherical bottom wall 8.

A suitable ballast material for securing in place in the bottom wall cavity 12 is concrete or mortar which can be poured in the cavity while wet and allowed to harden therein. The cylindrical side wall 6 of the lamp fixture and its hemi-spherical bottom wall 8 and top side walls 26 and 28 are preferably of a non-conductive material such as vinyl or other substantially solid plastic or non-conductive composition material. A suitable material for the transparent cover 35 may be plexiglass.

I claim:

1. A self-positioning lamp fixture, comprising an elongated supporting structure to be supported in a vertical position on a horizontal surface, said elongated supporting structure having an upper end and a lower end, a lamp mounted on said upper end, said lower end of said elongated structure including self-positioning means to position said elongated structure in said vertical position when placed on a said horizontal surface and to return it to said vertical position when tipped away therefrom, wherein said self-positioning means includes a bottom wall having a rounded outer surface, wherein said surface comprises a hemi-sphere, a hemi-spherical cavity bounded by said bottom wall comprising said hemi-sphere, and ballast means secured in said cavity to counter-balance the weight of that part of said lamp fixture spaced apart from said cavity and said ballast means secured therein, wherein said ballast means includes a volume of weighted material secured in place within said cavity, dispersed uniformly throughout, and of substantially equal weight on all opposite sides of the longitudinal axis of said cavity, wherein the curvature of said bottom wall comprising said hemi-sphere and of said hemi-spherical cavity terminates around the circumference thereof in an equatorial plane, said volume of weighted material secured in said cavity being spaced apart from said equatorial plane in the direction inwardly of said cavity.

2. A self-positioning lamp fixture, comprising an elongated supporting structure to be supported in a vertical position on a horizontal surface, said elongated supporting structure having an upper end and a lower end, said upper end including spaced apart first and second side walls, a lamp mounted on said upper end, said lower end of said elongated structure including self-positioning means to position said elongated structure in said vertical position when placed on a said horizontal surface and to return it to said vertical position when tipped away therefrom, wherein said self-positioning means includes a bottom wall having a rounded outer surface, wherein the curvature of said bottom wall terminates around the circumference thereof in an equatorial plane, said volume of weighted material secured in said cavity being spaced apart form said equatorial plane in the direction inwardly of said cavity, including a mounting rod supported for rotational adjustment between said first and second side walls of said upper end of said elongated supporting structure, said lamp being secured to said mounting rod, and adjustment operating means to adjustably rotate said mounting rod and said lamp secured thereto for adjustment of the light emitting angle of said lamp.

3. A self-positioning lamp fixture as set forth in claim 2, wherein said first and second side walls of said upper end of said elongated supporting structure include curved outer surfaces which lie in the curvature of a hemi-sphere having a circumference around its terminating edge corresponding in dimension to that of said elongated cylindrical wall integrally joined at its said upper end to said first and second side walls of said upper end of said elongated supporting structure.

4. A self-positioning lamp fixture as set forth in claim 3, including a transparent cover over said mounting space in which said lamp is mounted, said transparent cover includes a curved outer surface which lies in said curvature of a said hemi-sphere in which said curved outer surfaces of said first and second side walls of said upper end of said elongated supporting structure lie.

5. A self-positioning lamp fixture as set forth in claim 2, including shock-absorbing mounting means positioned between said mounting rod and said lamp to cushion the impact of any collision against the said lamp fixture on said lamp and thereby protect it against damage.

6. A self-positioning lamp fixture as set forth in claim 5, wherein said shock-absorbing mounting means includes a first resilient member secured to one side of said lamp, a second resilient member secured to the opposite side of said lamp, said mounting rod being divided into a first part and a second part each terminating inwardly of said mounting space at insert ends, said first and second resilient members each including small diameter expandable receiving recesses facing outwardly from said lamp, said insert end of said first part of said mounting rod being grippingly received in said expandable receiving recess of said first resilient member, said insert end of said second part of said mounting rod being grippingly received in said expandable receiving recess of said second resilient member.

* * * * *